US006853290B2

(12) United States Patent
Jorgensen et al.

(10) Patent No.: US 6,853,290 B2
(45) Date of Patent: Feb. 8, 2005

(54) SWITCH/VOLUME CONTROL ASSEMBLY

(75) Inventors: Martin Bondo Jorgensen, Værløse (DK); Karsten Videbæk, Roskilde (DK)

(73) Assignee: Sonion Roskilde A/S, Roskilde (DK)

( * ) Notice: Subject to any disclaimer, the term of this patent is extended or adjusted under 35 U.S.C. 154(b) by 0 days.

(21) Appl. No.: 10/197,604

(22) Filed: Jul. 18, 2002

(65) Prior Publication Data

US 2003/0024799 A1 Feb. 6, 2003

Related U.S. Application Data

(60) Provisional application No. 60/306,404, filed on Jul. 20, 2001.

(51) Int. Cl.[7] ..... H01C 10/50

(52) U.S. Cl. ..... 338/200; 338/197; 338/198; 338/199; 200/11 TW; 200/24; 200/60

(58) Field of Search ..... 338/197, 198, 338/199, 200; 200/24, 60, 37 R, 11 TW

(56) References Cited

U.S. PATENT DOCUMENTS

| | | | | |
|---|---|---|---|---|
| 3,195,358 A | | 7/1965 | Davidson et al. | |
| 3,284,584 A | | 11/1966 | Didyk | |
| 3,641,288 A | | 2/1972 | Lamp | 200/52 |
| 3,665,127 A | * | 5/1972 | Lockard et al. | 200/11 TW |
| 3,699,279 A | * | 10/1972 | Lockard et al. | 200/11 G |
| 3,719,785 A | * | 3/1973 | Kendall et al. | 200/11 TW |
| 3,809,830 A | * | 5/1974 | Lockard et al. | 200/11 TW |
| 3,958,087 A | * | 5/1976 | Mol et al. | 200/17 R |
| 4,081,782 A | | 3/1978 | Hildreth et al. | 338/200 |
| 4,117,444 A | * | 9/1978 | Hildreth et al. | 338/198 |
| 4,163,879 A | * | 8/1979 | Mayer et al. | 200/11 TW |
| 4,190,749 A | * | 2/1980 | Erickson et al. | 200/11 TW |
| 4,368,365 A | * | 1/1983 | Jacquet | 200/11 TW |
| 4,400,685 A | * | 8/1983 | Chestnut | 338/172 |
| 4,598,177 A | * | 7/1986 | McGroarty et al. | 381/323 |
| 4,736,430 A | | 4/1988 | Schroder | 381/68.6 |
| 5,117,074 A | | 5/1992 | Yanai et al. | 200/302.3 |
| 5,426,412 A | * | 6/1995 | Tomonari et al. | 338/18 |
| 5,781,099 A | * | 7/1998 | Joschika et al. | 338/162 |
| 5,847,346 A | * | 12/1998 | Hoskins et al. | 200/296 |
| 5,854,456 A | * | 12/1998 | Lee-ven | 200/11 TW |
| 5,917,402 A | * | 6/1999 | Ebata | 338/160 |
| 6,204,749 B1 | * | 3/2001 | Ishihara | 338/176 |

FOREIGN PATENT DOCUMENTS

| | | |
|---|---|---|
| CH | 663684 | 12/1987 |
| DE | 2441469 | 3/1976 |
| DE | 4331382 | 11/1994 |
| WO | WO 00/65692 | 11/2000 |

* cited by examiner

*Primary Examiner*—Karl D. Easthom
(74) *Attorney, Agent, or Firm*—Harness, Dickey & Pierce, PLC

(57) ABSTRACT

The present invention relates to switch or volume control assemblies, in particular to switch or volume control assemblies to be mounted in e.g. hearing aids, said assembly comprising a movable member, such as a wheel-like member positioned between at least two detachable parts defining the exterior of a housing, the movable member having a part extending out of the housing, the movable member engaging a contact member so as to move the contact member with the movable member.

17 Claims, 8 Drawing Sheets

SWITCH/VOLUME CONTROL ASSEMBLY

Applicant claims benefit under 35 USC 119 of continuity with provisional application 60/306,404 file on Jul. 20, 2001.

FIELD OF THE INVENTION

The invention relates to a switch/volume control assembly to be inserted in an apparatus, in particular hearing aids, the assembly providing a moisture-protection for the electrical parts of the switch and apparatus.

BACKGROUND OF THE INVENTION

Liquid running into the electrical parts is one of the parameters affecting the lifetime and operability of electronic instruments, such as hearing aids. Penetration of liquids—e.g. water or sweat running from the scalp into e.g. electrical contacts will typically result in malfunctions of the hearing instrument.

U.S. Pat. No. 3,195,358 discloses weather-tight instrument housings and assemblies for switches, potentiometers and the like. The modular unit of the instrument housings includes a basic housing portion having substantially parallel front and back sides and a generally cylindrical cavity for containing adjustable electrical mechanism formed in the back surface.

U.S. Pat. No. 4,081,782 discloses a potentiometer and switch combination including a rotatable control cap positioned over a potentiometer body to form a housing. The cap is provided with an annular flange which abuts an annular shoulder on the body, either the flange or the shoulder being formed from stiffly flexible, resilient material. The body holds the cap in place by means of a post having a chevron at its upper end which mates with a recess in the cap. The cap is positioned to deform the stiffly flexible, resilient material into frictional sealing relation with its abutting member and thereby seal the interior of the housing. Rotating the cap moves a blocking member out from between the contacts, permitting them to close, and also causes a spring detent to snap against the blocking member and give the operator a positive switch feel.

It is a disadvantage of the inventions disclosed in the above-mentioned references that the member to be used in activating the device is not encapsulated, or at least partly encapsulated, in a housing—see e.g. the rotatably mounted member 30 in FIG. 2 of U.S. Pat. No. 3,195,358. This non-encapsulated member makes it rather difficult to integrate the device of U.S. Pat. No. 3,195,358 in an outer wall of another small device/apparatus, such as a hearing aid.

SUMMARY OF THE INVENTION

It is an object of the present invention to provide a switch or volume control to be inserted into an apparatus, and wherein the switch provides a waterproof environment for the electrical parts of the apparatus and switch/volume control.

According to a first aspect, the present invention relates to a switch or volume control assembly to be mounted in a wall of an apparatus, such as a hearing aid, said assembly comprising:

- a housing having an inner sidewall comprising connection parts for providing a waterproof connection between the housing and the wall of the apparatus,
- an inner portion bounded by an inner sidewall and positioned inside said housing, said inner sidewall and said outer sidewall being separated by a groove,
- one or more electrical terminals extending from outside the housing into said inner portion, so as to form one or more contact areas on a surface within said inner portion,
- a contact member positioned inside said inner portion for providing continuous or periodical contact between said contact area(s) and/or between contact area(s) and the contact member, and
- a movable member positioned inside the housing and between at least two detachable parts defining the exterior of the housing, the movable member having a part extending out of the housing, and the movable member engaging said contact member so as to move the contact member with the movable member.

Preferably, the housing may be defined by two detachable parts. The detachable parts may be screwed, glued or electric welded together.

The assembly may be used for analogous or digital instruments. The contact member may comprise e.g. a potentiometer (for analogous instruments), or it may comprise e.g. an encoder (for digital instruments). Thus, the terminals may provide analogous or digital outputs for the electrical components to which the assembly is connected.

Preferably, the terminals extend in the sidewall of the housing when extending from outside and into the inner portion of the assembly, so that the terminals do not enter the groove and thus not get into contact with moisture.

From now on "switch or volume control" is referred to as "switch".

Preferably, the apparatus comprises hearing aids, such as BTE (Behind The Ear) and ITE (In The Ear) hearing aids, or it may comprise other electrical instruments such as mobile phones. The switch may be used for a variety of purposes such as programming of the instrument, changing between different pre-programmed listening programs or changing between a microphone and a telecoil audio signal or turning a battery supply on-off or adjusting the volume.

The user may operate the switch by an operating part of the movable member, which passes through an opening in the housing.

The connection parts may comprise a flange surrounding said opening and being adapted to engage with recesses in said wall of the apparatus. Thus, the switch may be inserted into a prefabricated housing having recesses adapted to engage with the flange. Alternatively, the assembly may be mounted to the wall of the apparatus by means screws or glue providing a waterproof mounting.

As the switch comprises an inner portion surrounding the contact areas, moisture cannot enter into the contact areas resulting in malfunction of the apparatus in which the assembly is inserted. Moisture, which may enter through the opening of the housing, will be caught in the groove ("bathtub") that separates the sidewall of the housing and the inner wall of the inner portion.

Preferably, the assembly comprises an axle mounted inside said inner portion and around which the movable member and the contact member can rotate.

In many known apparatuses the switch is only maintained by the terminals soldered to a print circuit board, and as operation of the switch often provides a load on the switch, the terminals often break due to that load. Therefore, the present invention provides a much more reliable switch, as the switch via its housing is fastened to the wall of the apparatus, so that no load is transferred to the terminals when operating the switch, but only to the axle that is mounted to the housing.

The movable member may comprise a wheel for e.g. controlling the volume and/or a contact/switch that is movable between different predefined positions.

In an embodiment, the movable member may have the form of a mill wheel comprising projections along its circumference for providing friction between the wheel and a finger of an operator. The wheel may be made of a resilient material, such as rubber, TPE.

Preferably, the sidewall of the housing is circular and the mill wheel positioned such that the projections substantially scrape along the internal side of the sidewall of the housing, so as to scrape moisture from said groove and out of the housing when rotating the wheel. Thus, the moisture will be transported out from the groove of the switch.

The terminals may be positioned in first holes in the inner portion for providing a first set of contact areas, but in another embodiment one or more of the terminals may be positioned in second holes for providing a second set of contact areas. Thus, it is possible to change between different contact areas depending on which kind of output that is needed. The first and second holes may be provided in the same assembly, so that the terminals can be displaced, or different assemblies may be produced, some of them having first set of contact areas and some of them having second set of contact areas. One of the terminals may be positioned such that it is always in contact with the encoder (and the axle), or all terminals may be positioned such that they are in periodical contact with the encoder. Thus, both Gray-code and XYZ-code may be available when using encoder.

The assembly may comprise two or three or more terminals depending on e.g. the number of signals to be provided.

The part of the terminal(s) outside the housing may be connected to a print circuit board by soldering it thereto, or it they may be connected to the print circuit via a flexible printed circuit strip having one or more electrical conductors for one or more terminal(s). The terminals and the conductors may be hold into engagement with each other by means of a clamp.

In order to obtain as good connection between the conductors and the terminals as possible, the clamp may comprise projections, each of which being adapted to engage with a part of a terminal outside the housing.

The clamp may be hinged connected on the outer side of the housing and maintained in its clamping position by means of clips.

By using the flexible print circuit strip, the switch can easily be removed from the apparatus by loosening the clamp.

In another embodiment, the part of the terminals outside the housing is arranged such that they may be connected to the flexible printed circuit strip by means of the connection assembly disclosed in the International Application No. PCT/DK00/00203.

According to a second aspect, the present invention relates to a hearing aid comprising a housing with a sidewall having an opening for receiving a switch or volume control assembly, and an assembly according to the first aspect positioned in said opening.

BRIEF DESCRIPTION OF THE DRAWINGS

Preferred embodiments of the invention will be described in details below with reference to the figures, wherein.

DETAILED DESCRIPTION OF THE INVENTION

Figure 1:
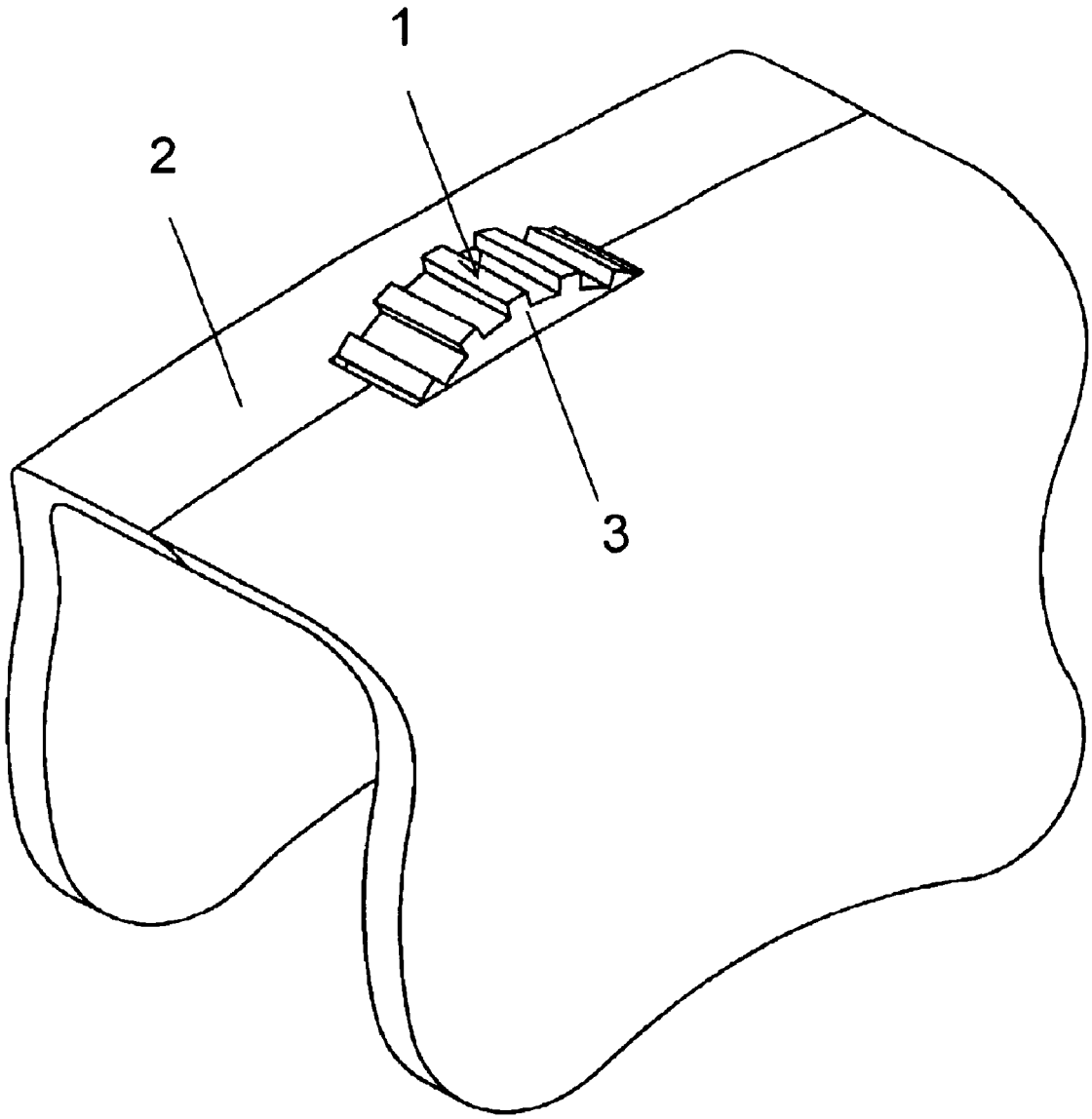
FIGS. 1–2 show a part of a hearing aid (BTE) in which the switch or volume control assembly according to the invention is mounted.
Figure 2:
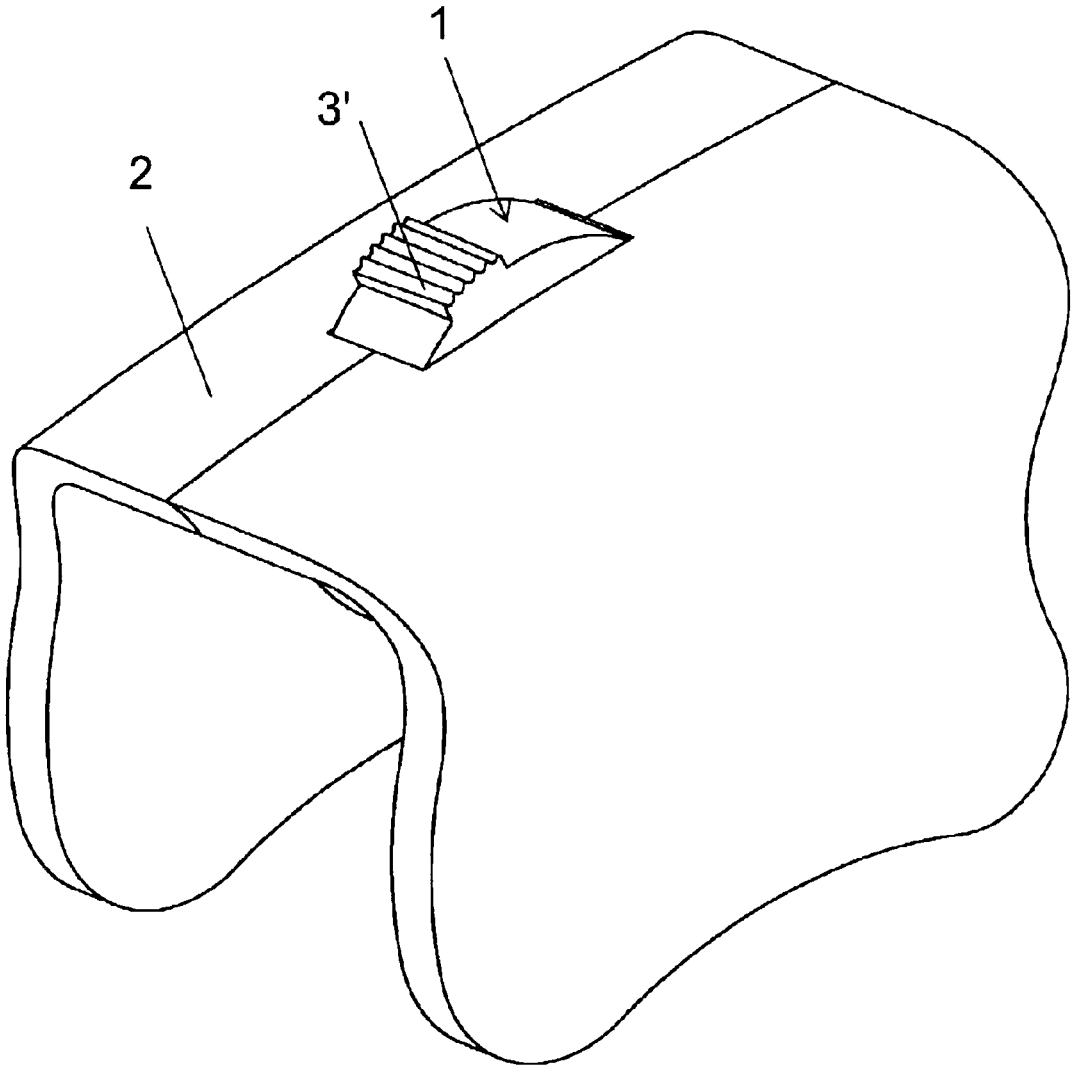

FIGS. 1–2 show a sidewall 2 of a hearing aid in which the switch assembly 1 is mounted. The assembly is operated by rotation of the wheel 3. In FIG. 1 the assembly composes a wheel 3 (e.g. volume control) and in FIG. 2 it composes a switch/contact 3'.

Figure 3:
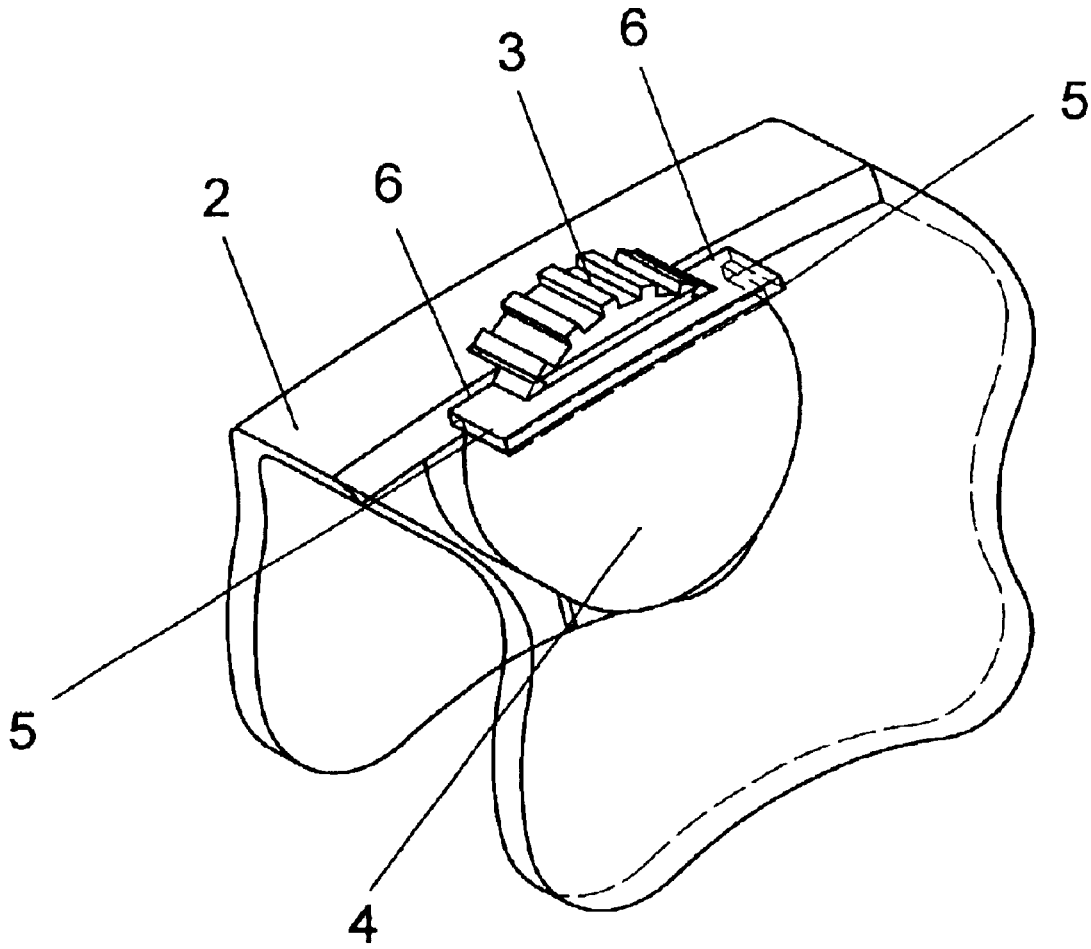
FIG. 3 shows the hearing instrument with the assembly according to the invention.

FIG. 3 shows the housing 4 of the assembly mounted in the sidewall 2. The housing 4 comprises flanges 5 that engage with recesses 6 in the sidewall and thus provide a waterproof connection therebetween.

Figure 4:
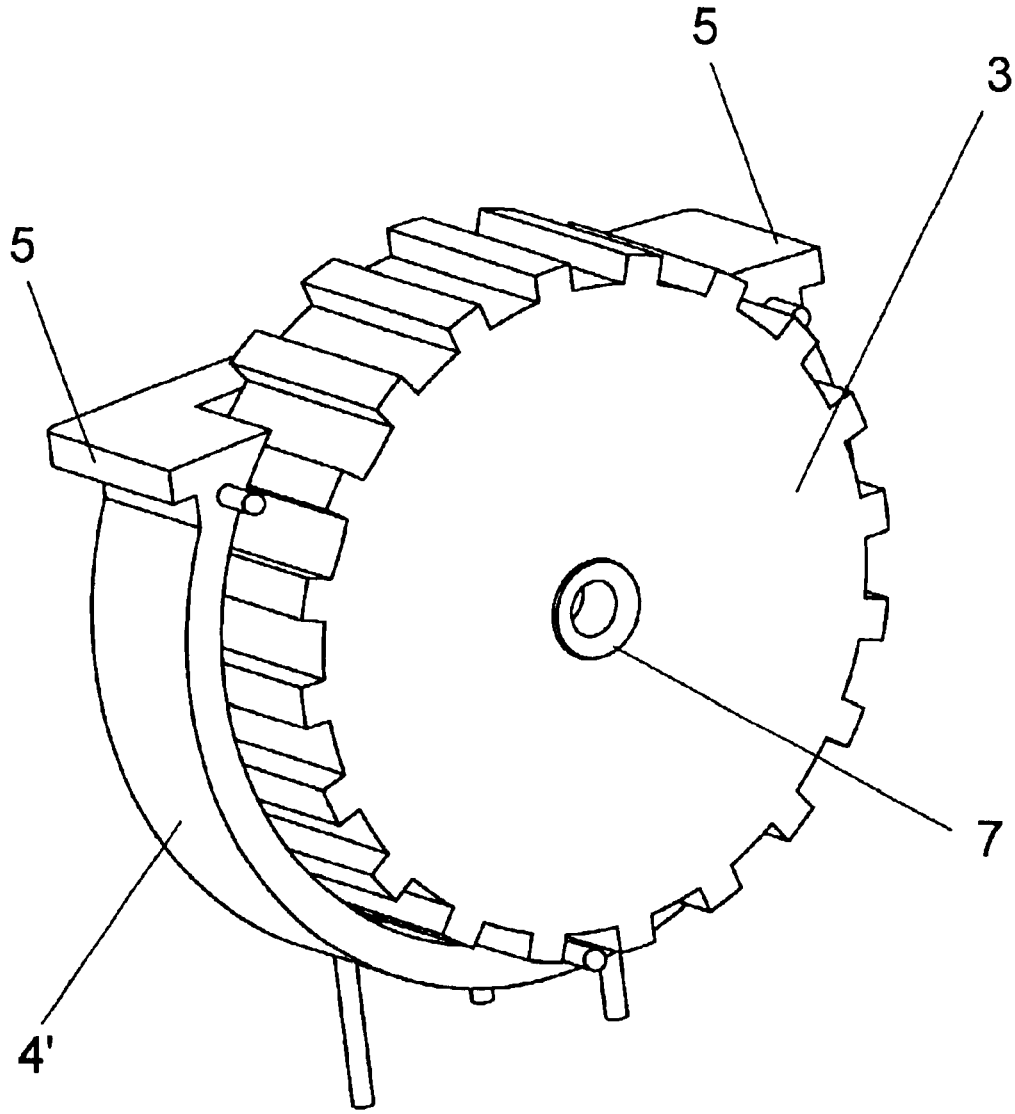
FIG. 4 shows a part of a volume control with a mill wheel according to the invention.

FIG. 4 shows the assembly comprising a mill wheel 3 (e.g. a volume control) mounted on the axle 7 that is mounted to one (4') of two detachable parts of the housing. The housing comprising flanges 5.

Figure 5:
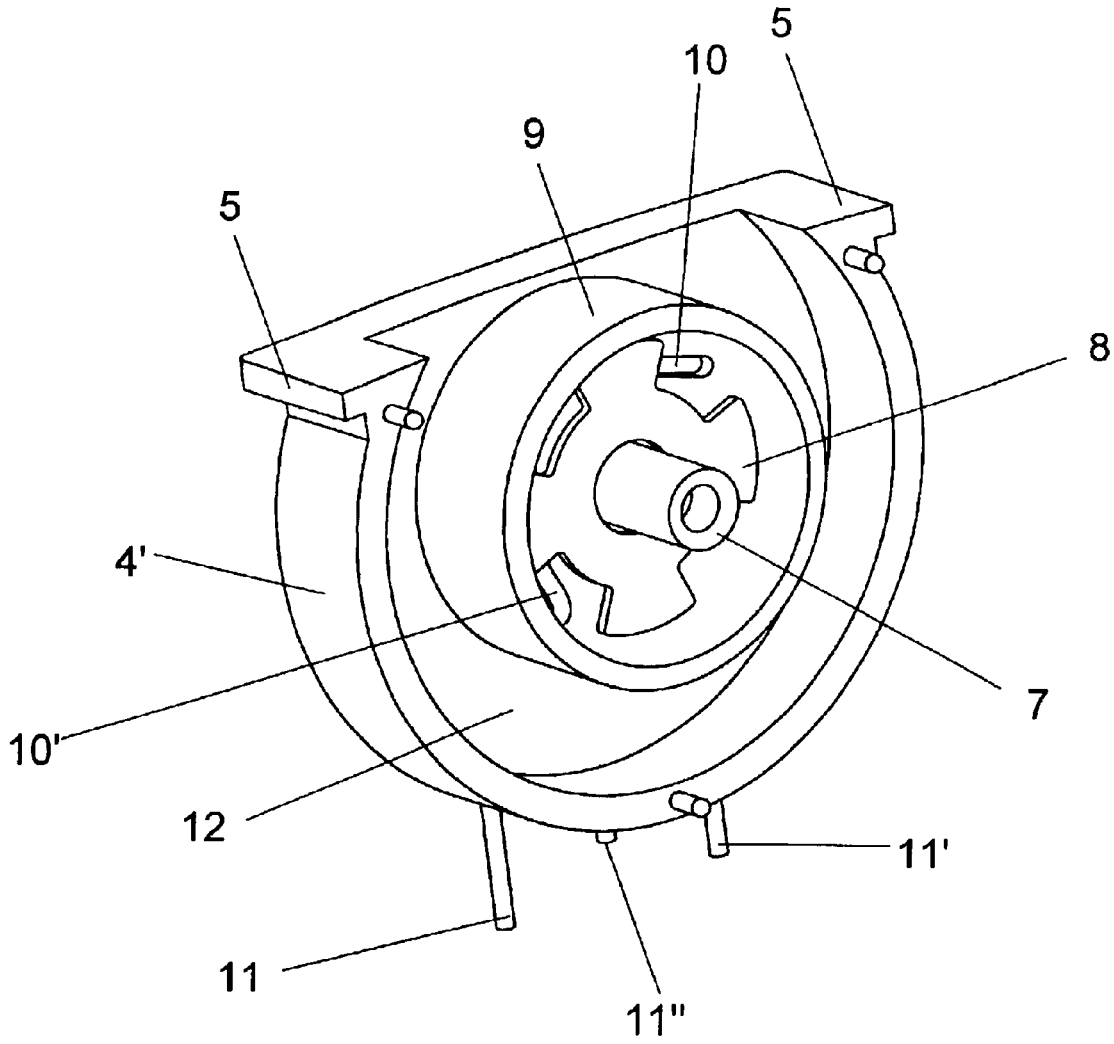
FIGS. 5–6 show a part of the assembly according to the invention.

FIG. 5 shows the assembly wherein the mill wheel 3 of FIG. 4 is removed. An encoder 8 is positioned inside the inner wall portion 9 of the inner portion of the housing. The encoder 8 engages with the wheel 3 (see FIG. 4) when the wheel is mounted in the housing, whereby the encoder is turned when turning the wheel. The encoder gets in touch with the terminals 10, 10', and 10" (not shown) defining contact areas in the inner portion 9, whereby e.g. the volume may be adjusted in a known manner. The terminals have legs part 11, 11' and 11" outside the housing, such that the switch easily can be mounted in a print circuit. One of the terminals (10, 10' and 10") may be positioned such that is always is in contact with the encoder and not just when the arms of the encoder passes.

A groove 12 is provided between the sidewall of the housing and the inner wall 9, so as to catch moisture that may pass through the passage between the housing of the assembly and the wheel or switch (see FIG. 1 or 2).

Figure 6:
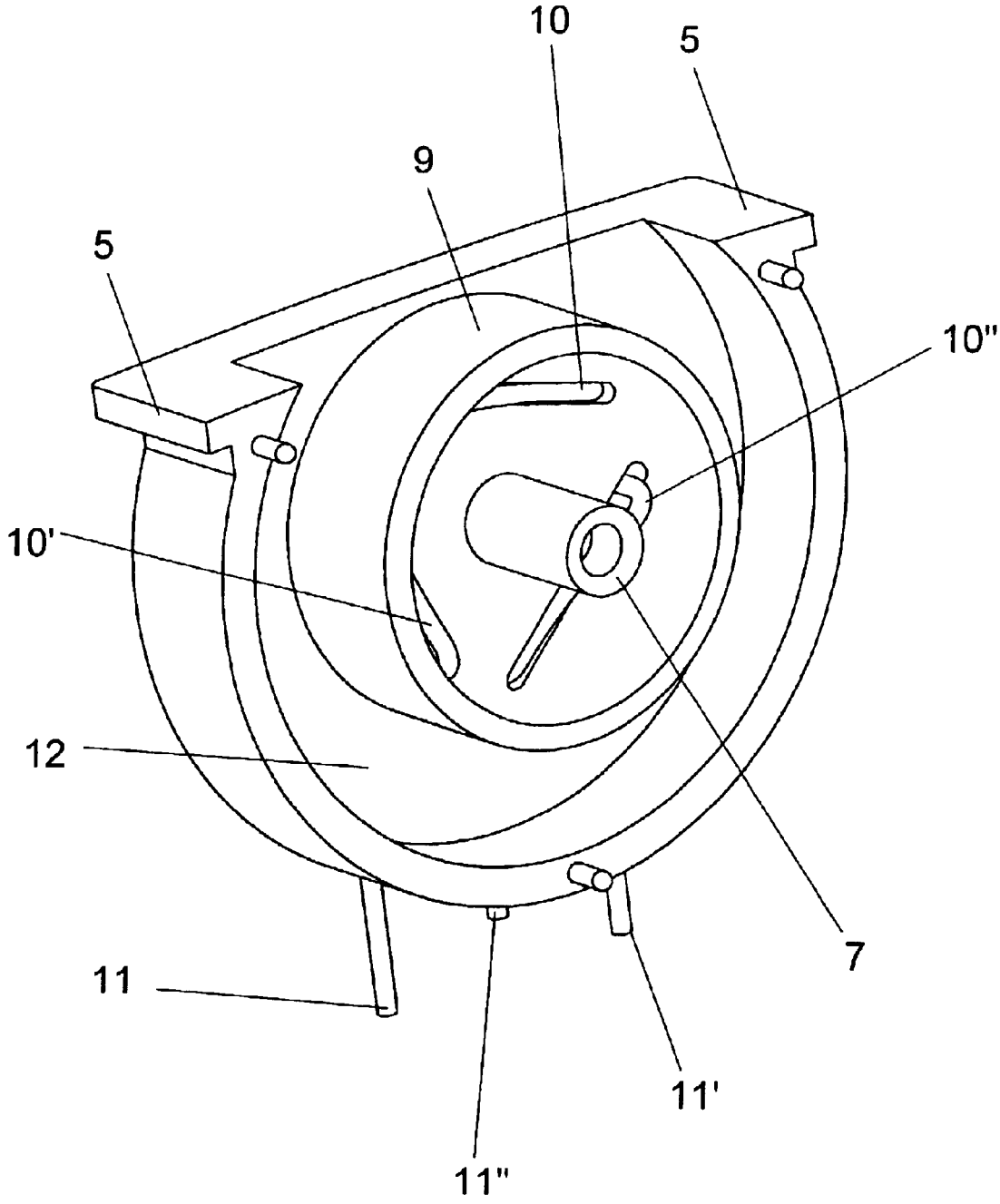

FIG. 6 shows the detachable part 4', wherein the encoder 8 is removed. One or more of the terminals 10, 10' and 10" may be positioned at different distances from the axle depending on whether the terminal should be in continuous contact or periodical contact with the encoder.

Figure 7:
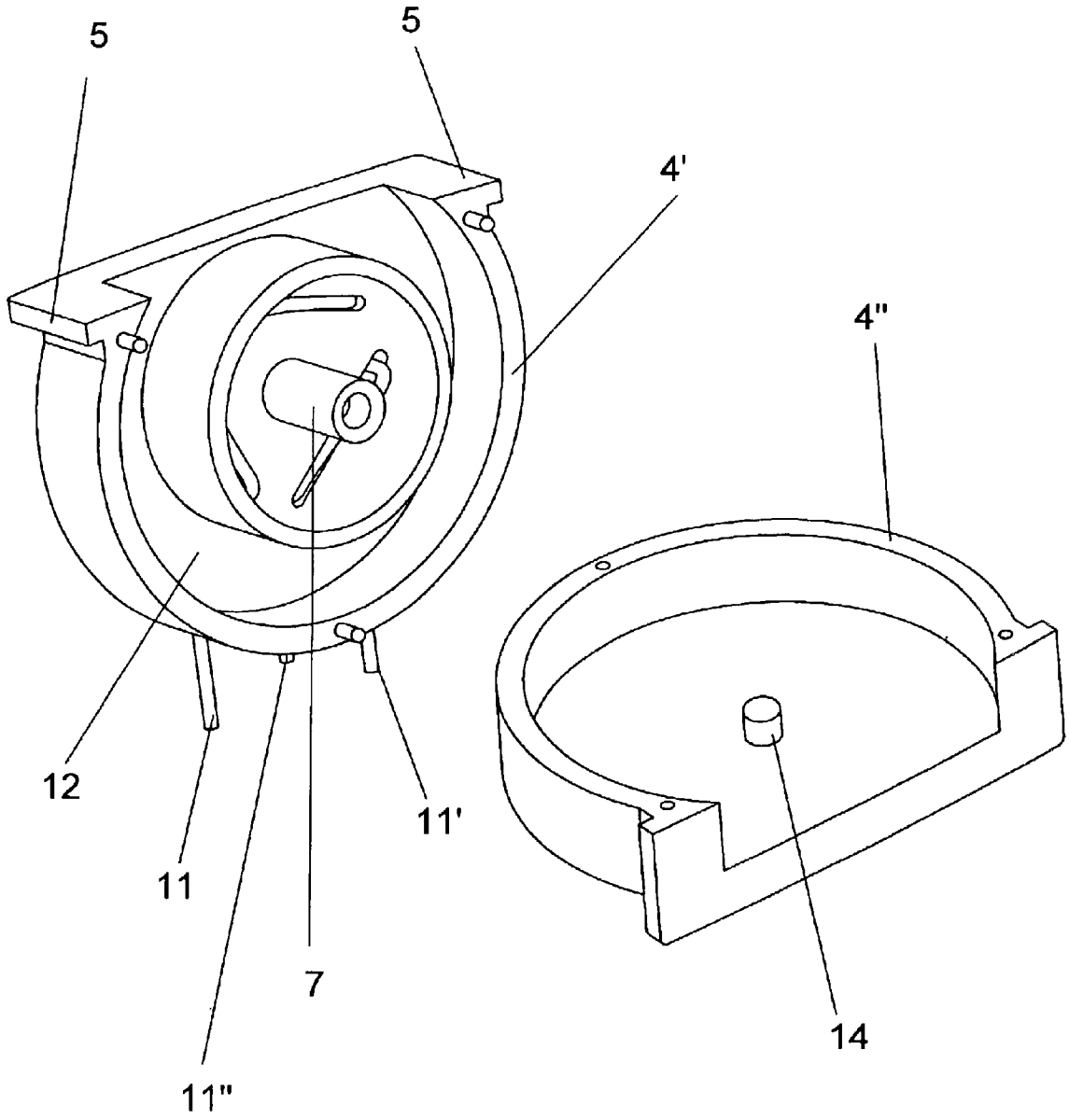
FIG. 7 shows the two detachable parts of the assembly according to the invention.

FIG. 7 shows the two detachable parts 4' and 4", which together forms a waterproof housing for the switch. The part 4" comprises a supporting rod 14 for the axle 7.

Figure 8:
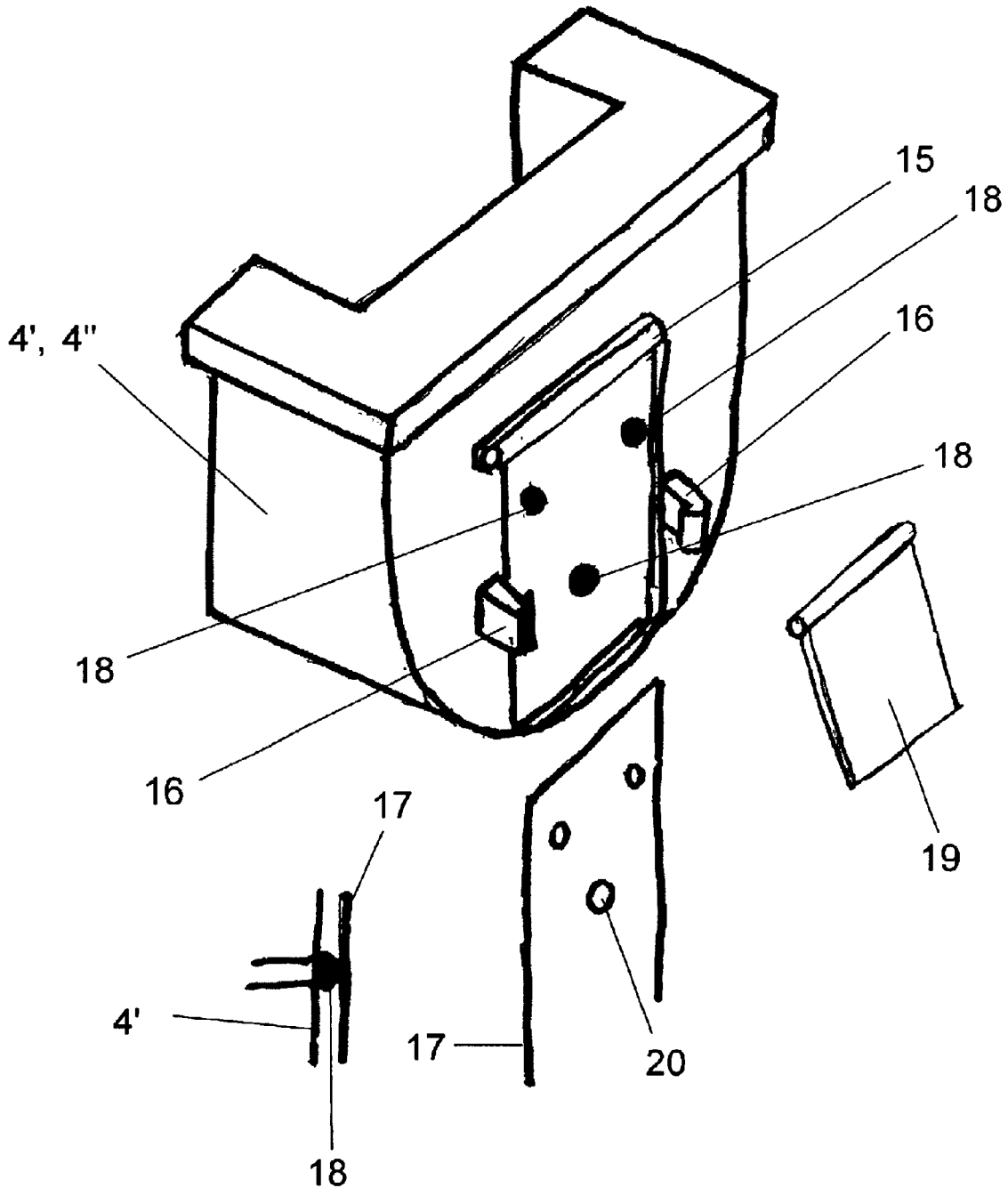
FIG. 8 shows outer terminals to be attached to a flexible printed circuit strip.

FIG. 8 shows a detachable part (4' or 4") having outer terminals 18 to be attached to a flexible printed circuit strip or board 17. The terminals 18 are formed as projections that are adapted to engage with the electrical conductors 20 of the flexible printed circuit board 17. In order to provided a proper engagement between the terminals and the conductors 20, a hinged clamp 19 is provided. The clamp may be hinged in the hinge 15 and maintained in the clamping position by means of clips 16. Four or more terminals may be provided on the side of the detachable part 4', and the flexible print circuit may comprise four or more conductors.

What is claimed is:

1. A switch or volume control assembly for mounting in a wall of an apparatus said assembly comprising:

(a) at least first and second detachable parts defining an exterior of the assembly, the detachable parts being arranged to provide a substantially circular outer sidewall of the assembly;

(b) an inner portion inside said assembly bounded by an inner sidewall, said inner sidewall and said outer sidewall being separated by a intermediate space and being concentrically arranged, the inner sidewall establishing a waterproof connection between the intermediate space and the inner portion;

(c) connection parts included in association with the at least first and second detachable parts, said connection parts operable to provide a waterproof connection between the assembly and the wall of the apparatus;

(d) one or more electrical terminals extending from outside the assembly into said inner portion so as to form one or more contact areas on a surface within said inner portion, (e) a contact member positioned inside said inner portion for providing continuous or periodical contact between said one or more contact areas and between one or more contact areas and the contact member, and (f) a substantially circular and rotatably mounted movable member positioned inside the assembly and between said at least first and second detachable parts thereby occupying at least part of the intermediate space between the inner and outer sidewall, the movable member having a part extending out of the assembly so as to enable user access to the movable member, and the movable member engaging said contact member so as to move the contact member with the movable member, the movable member further having the form of a mill wheel comprising projections along its circumference for providing friction between the wheel and a finger of an operator, wherein the mill wheel is positioned such that the projections substantially scrape along an internal side of the outer sidewall of the assembly, so as to scrape moisture from said intermediate space and out of the assembly when rotating the wheel.

2. An assembly according to claim 1, wherein the contact member comprises a potentiometer.

3. An assembly according to claim 1, wherein the contact member comprises an encoder.

4. An assembly according to claim 1, further comprising an axle mounted inside said inner portion and around which the movable member and the contact member are adapted to rotate.

5. An assembly according to claim 1, wherein the movable member comprises a contact or a switch that is movable between different predefined positions.

6. An assembly according to claim 1, wherein the detachable parts are electrically welded together.

7. An assembly according to claim 1, wherein the terminals are positioned in first holes in the inner portion for providing a first set of contact areas.

8. An assembly according to claim 1, wherein the inner portion comprises second holes in which one or more of the terminals can be positioned for providing a second set of contact areas.

9. An assembly according to claim 1, wherein the wheel is made of a resilient material.

10. An assembly according to claim 9, wherein the resilient material is at least one material chosen from the group consisting of: rubber and TPE.

11. An assembly according to claim 1, comprising two, three or more outer terminals.

12. An assembly according to claim 1, wherein the part of the terminal(s) outside the assembly are connected to an associated printed circuit board.

13. An assembly according to claim 12, wherein the terminals are soldered to the associated printed circuit board.

14. An assembly according to claim 12, wherein the terminals are connected to the printed circuit board via a flexible printed circuit strip having electrical conductors for one or more terminal(s), the terminals and the conductors being hold into engagement with each other by means of a clamp.

15. An assembly according to claim 14, wherein the clamp comprises projections or holes, each of which being adapted to engage with a part of a terminal outside the assembly.

16. A hearing aid instrument comprising:

a housing with a sidewall having an opening for receiving a switch or volume control assembly, and an assembly according to claim 1 positioned in said opening.

17. An assembly according to claim 1, wherein the inner sidewall is substantially circular in shape.

* * * * *